United States Patent [19]

Forte

[11] Patent Number: 5,020,449

[45] Date of Patent: Jun. 4, 1991

[54] SHELVED COMPUTER STAND

[76] Inventor: Jerry K. Forte, Rte. 1, Box 313, Hibbing, Minn. 55746

[21] Appl. No.: 465,641

[22] Filed: Jan. 22, 1990

Related U.S. Application Data

[63] Continuation of Ser. No. 228,327, Aug. 4, 1988, abandoned.

[51] Int. Cl.[5] ..... A47B 49/00

[52] U.S. Cl. ..... 108/92; 312/194; 248/918; 248/917

[58] Field of Search ..... 108/92, 93; 312/208, 312/194, 196, 252; 298/1 A, 1 B, 1 C, 917, 918

[56] References Cited

U.S. PATENT DOCUMENTS

| | | | |
|---|---|---|---|
| 148,580 | 3/1874 | Stevens | 108/92 |
| D. 283,323 | 4/1986 | Cervero . | |
| 2,792,126 | 5/1957 | Mapstone | 108/92 |
| 3,276,399 | 10/1966 | Canfield . | |
| 3,384,037 | 5/1968 | Blevins . | |
| 3,635,174 | 1/1972 | Ball | 312/194 X |
| 3,862,785 | 1/1975 | Scheerhorn et al. | 312/196 X |
| 4,418,967 | 12/1983 | Winkleman, Jr. et al. | 312/194 X |
| 4,449,762 | 5/1984 | Turner . | |
| 4,600,249 | 7/1986 | Anderson . | |
| 4,600,250 | 7/1986 | Windham . | |
| 4,624,510 | 11/1986 | Jedziniak | 248/1 A |
| 4,640,199 | 2/1987 | Zigman . | |
| 4,646,655 | 3/1986 | Robolin . | |

*Primary Examiner*—Peter A. Aschenbrenner

*Attorney, Agent, or Firm*—Merchant, Gould, Smith, Edell, Welter & Schmidt

[57] ABSTRACT

A multi-shelved support device is provided which permits simultaneous mounting of electronic equipment components on different shelves while maintaining electrical connection between the components. The electrical cabling connecting the equipment is stored within the area defined by the length and width of the lowest shelf.

4 Claims, 2 Drawing Sheets

SHELVED COMPUTER STAND

This is a continuation of application Ser. No. 07/228,327, filed Aug. 4, 1988, now abandoned.

FIELD OF THE INVENTION

The present invention relates generally to the field of support devices for electronic equipment and more specifically to a shelfed support stand for a computer and computer peripheral equipment.

BACKGROUND OF THE INVENTION

Numerous devices exist for support of computers and computer peripheral equipment. Typically, such devices comprise desk units or large work stations which may include one or more shelves. Many problems and structural incompatibilities exist in the prior art. For example, it is often desirable to protect the cabling which connects various pieces of equipment while simultaneously providing ready access to such cabling to achieve system flexibility. Indeed, when utilizing portable computers and related equipment, the characteristics of maximum security, safety, and accessibility are often quite incompatible. Prior art devices have generally taught increased protection for cabling at the expense of interchangeability of equipment mounted on such a structure.

Accordingly, there has been a need for a multi-shelfed support device for electronic equipment, such as a computer and computer peripherals, which permits mounting of peripherals without removing the cabling therebetween. What has been further needed is a device which includes protection for equipment cabling to prevent damage and to enhance electrical safety. What has been still further needed has been a tri-shelfed support device suitable for receipt of a computer and computer peripherals which provides stable protection for the equipment during use and which provides overall ease of transportability.

SUMMARY OF THE INVENTION

The present invention is a shelfed support device for electronic equipment which includes a back wall and horizontally oriented shelf means. The horizontally oriented shelf means comprise a lower shelf which is connected to the back wall and which includes an area defined by a length and a width. The shelf means further includes an upper shelf connected to the back wall, and a middle shelf located between the upper shelf and a lower shelf. The device also includes means for maintaining the middle shelf at a predetermined location relative to the upper shelf, and means for simultaneously mounting electronic equipment on both the lower shelf and the middle shelf while maintaining a path of electrical conductivity between the equipment. The path of electrical conductivity is maintained within and above the area defined by the lower shelf.

DETAILED DESCRIPTION OF THE PREFERRED EMBODIMENTS

Detailed preferred embodiments of the present invention are disclosed. It is to be understood, however, that the disclosed embodiments are merely exemplary of the invention, which may be embodied in various forms. Therefore, specific structural and functional details disclosed are not to be interpreted as limiting, but rather as a representative basis for teaching one skilled in the art to variously employ the present invention in virtually any appropriately detailed system or structure. It would be understood that in some circumstances relative material thicknesses and relative component sizes may be shown exaggerated to facilitate an understanding of the invention.

Figure 1:
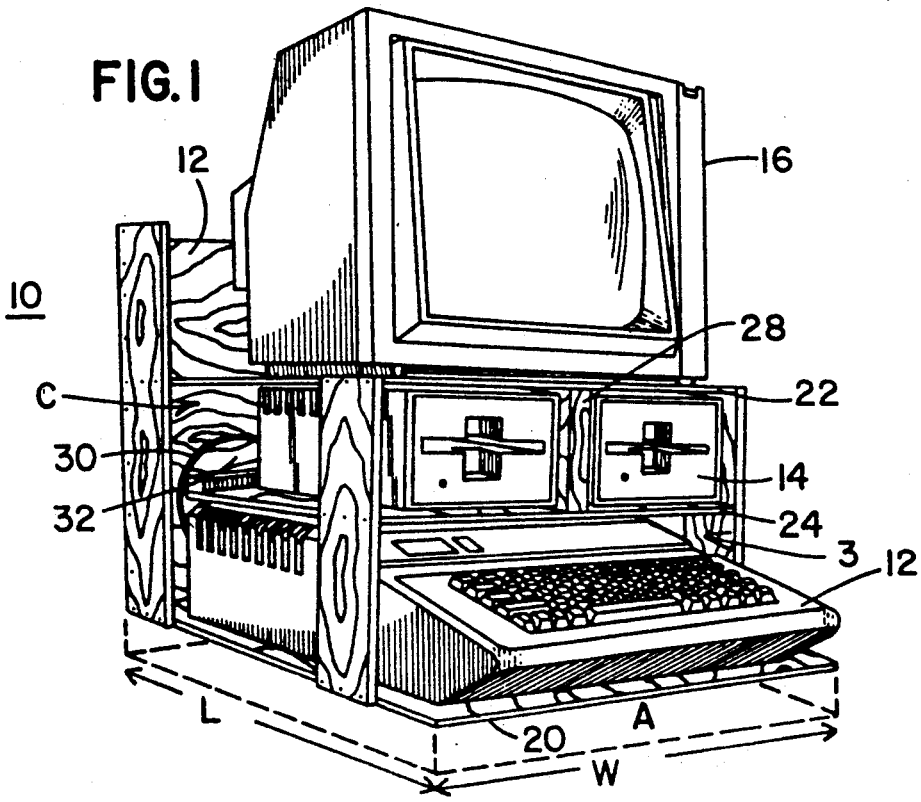
FIG. 1 is a front perspective view of a shelfed support device illustrating use of a cable storage space between the middle shelf and the back wall.

Referring to FIG. 1, a shelfed support device 10 is illustrated which is constructed and arranged to support electronic equipment such as a computer 12, disk drives 14, and a computer monitor 16. Computer users, such as those found in schools or businesses, desire computer support structures which maximize electrical, equipment, and personnel safety and security, but which also permit system flexibility and portability. Heretofore, prior art devices have not effectively combined those characteristics. Generally, devices which are in use offset either safety, security, transportability, or system flexibility in order to be functional. However, shelfed support device 10 enhances safety, security, transportability, and system flexibility through use of various novel features.

Shelfed support device 10, as illustrated in FIG. 1, includes a back wall 18, and a lower shelf 20 which is connected to back wall 18 in a preferred perpendicular orientation. The lower shelf 20 includes an area A defined by length L and width W. An upper shelf 22 is provided and is also connected to the back wall in a preferred perpendicular orientation. A middle shelf 24 is located between upper shelf 22 and lower shelf 20. As depicted in FIG. 1, exemplary computer 12 is positioned on lower shelf 20, while exemplary disk drives 14 are positioned on middle shelf 24, and exemplary computer monitor 16 is positioned on upper shelf 22. It is to be appreciated that various configurations of different electronic equipment may be positioned on shelfed support device 10, and that the equipment forms know part of this invention per se.

As will be further detailed, shelfed support device 10 is constructed and arranged to allow installation or removal of a disk drive 14 onto middle shelf 24 even when the disk drive is already electrically connected to computer 12. Installation of disk drive 14 is readily accomplished by passing the drive through opening B, where computer 12 will be located, and then maneuvering the drive out of a side opening C on either side of device 10 and positioning the drive in a preferred location on middle shelf 24. As will also be further described, the means for electrically connecting disk drive 14 and computer 12, such as electrical cabling, is conveniently positioned throughout the installation sequence to prevent tangling or disconnection from either disk drive 14 or computer 12. Computer 12 is also then readily positioned on lower shelf 20. Removal of computer peripheral equipment, such as disk drives 14, from middle shelf 24 is accomplished in substantially the reverse order of the above-described installation sequence.

Means for maintaining middle shelf 24 at a predetermined location relative to upper shelf 22 must be provided. As illustrated in FIG. 1, a particular means for maintaining the location of the middle shelf includes vertically oriented medial connecting means 28 connected to middle shelf 24 and upper shelf 22. The precise material comprising medial connecting means 28, as well as the remainder of shelfed support device 10, is not crucial to achieve the advantages of the present invention. However, shelfed support device 10 is preferably constructed of durable, lightweight, and shock resistent material, such as wood or plastic. As further shown in FIG. 1, medial connecting means 28 also provides means for separating the area defined by middle shelf 24 into two smaller areas for receipt of discrete electronic components, in this case disk drives 14.

Shelfed support device 10 comprises means for simultaneously mounting or arranging electronic equipment components on different levels of the shelf means while maintaining a path of electrical conductivity between the components. The path of electrical conductivity, illustrated in FIG. 1 by cabling 30, is preferably maintained within and above the area A defined by lower shelf 20. Such means for simultaneous mounting of equipment in preferred shelfed support device 10 comprises a cable storage space 32 defined by back wall 18 and, preferably, middle shelf 24. Cable storage space 32 is constructed and arranged to permit electronic cabling 30 to extend between equipment located on lower shelf 20 and equipment located on middle shelf 24. For example, cabling 30 extending between disk drives 14 and computer 12 pass freely into cable storage space 32 to permit installation of disk drives 14 and computer 12 into shelfed support device 10 without disconnecting cabling 30 from either piece of equipment. Such utility contributes to improved electrically safety, equipment longevity, greater system flexibility, and overall improved ease of use. This feature is particularly important when using equipment with multiple pin type connections. In addition, rather than allowing cabling 30 to extend outside of shelfed support device 10, e.g. beyond area A, cable storage space 32 provides safe and compact storage for cabling 30.

Figure 2:
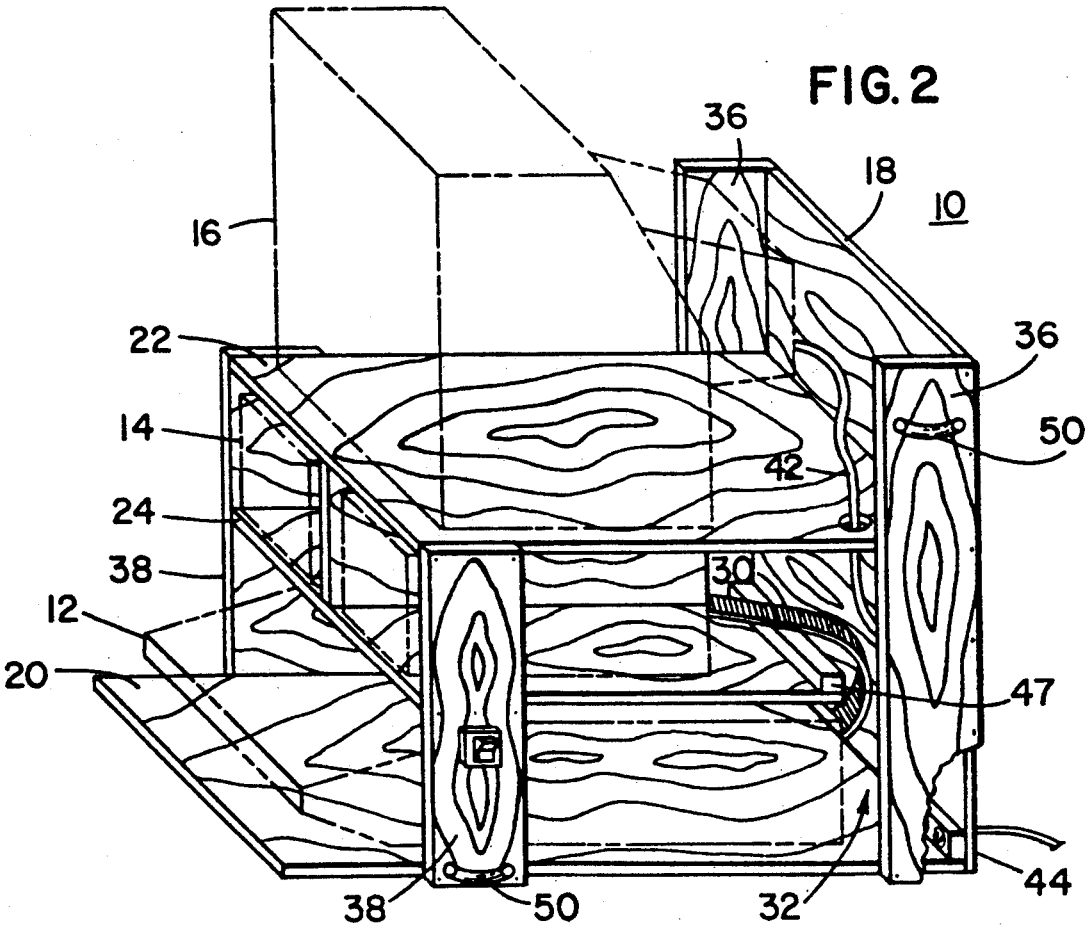
FIG. 2 is a side elevation view of a shelfed support device illustrating a cable storage space between the middle shelf and the back wall.

FIG. 2 is a side elevation view of a preferred shelfed support device 10 supporting computer 12 on lower shelf 20, disk drives 14 on middle shelf 24, and computer monitor 16 on upper shelf 22. FIG. 2 illustrates the storage, access, and protection functions of cable storage space 32. It may also be observed how device 10 allows simultaneous mounting of electronic equipment on both lower shelf 20 and middle shelf 24 while maintaining connection of cabling 30 between the respective pieces of equipment.

Shelfed support device 10 preferably includes means for strengthening device 10 by placement of vertically oriented strengthening members between lower shelf 20 and upper shelf 22. More particularly, the strengthening means comprises rear located strengthening members 36 which are attached on either side of shelfed support device 10 to back wall 18, lower shelf 20, and upper shelf 22. As illustrated in FIGS. 1 and 2, a preferred shelfed support device 10 includes rear located strengthening members 36 which are constructed and arranged to provide nominal barriers for protection of equipment cabling 30 and for electrical safety of personnel. The strengthening means preferably further comprises front located strengthening members 38 which are attached on either side of shelfed support device 10 to lower shelf 20, middle shelf 24, and upper shelf 22. Although the precise dimensions and location of front located strengthening members 38 and rear located strengthening members 36 may vary, it is desirable to provide substantial separation between the two members to permit equipment access and cooling. It is also possible to provide hinge means on a portion of rear located strengthening members 36 to further facilitate access to cabling 30 while also providing protection for cabling 30 and nearby personnel.

Further protection of cabling 30 may be accomplished by use of an access port 42 located in upper shelf 22 to permit cabling 30 to safely extend between equipment located on upper shelf 22, such as monitor 16, and equipment located below upper shelf 22. It is also desirable to include an aperture 44 in back wall 18 to permit passage of electrical cabling 30 therethrough. Yet another cable protection feature of shelfed support device 10 includes stop means 47. Stop means 47 may be selectively positioned on a shelf to maintain the electronic equipment at a predetermined location and thereby prevent damage to cabling 30, or pin connections at the back of the equipment, by improper pushing of the equipment against back wall 18.

As can be observed, the compact and stacked arrangement of shelfed support device 10 provides a readily transportable unit for computers and computer peripheral equipment. Accordingly, shelfed support device 10 may be readily utilized in association with personal computers and associated equipment. Handle means 50 may also be included to further facilitate portability of device 10.

Figure 3:
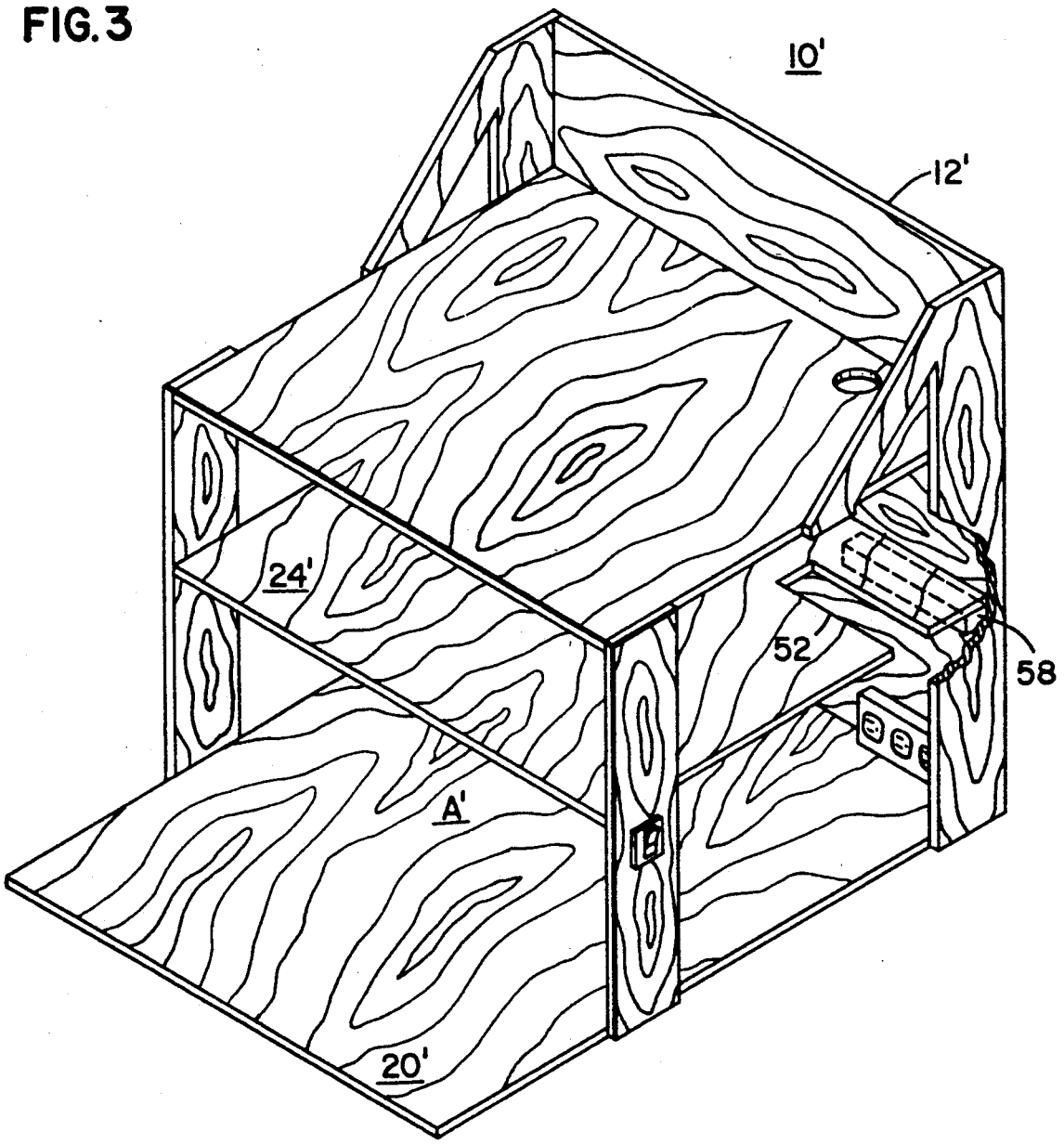
FIG. 3 is a front perspective view of an embodiment of the shelfed support device illustrating a cable storage slot extending through a portion of the middle shelf proximate the back wall.

FIG. 3 is a perspective view of an alternate embodiment shelfed support device 10'. As shown, shelfed support device 10' includes means for simultaneously mounting electronic equipment on both lower shelf 20' and middle shelf 24' by use of a cable storage slot 52. Cable storage slot 52 provides similar advantages to cable storage space 32 illustrated in FIGS. 1 and 2. Cable storage slot 52 extends through a portion of middle shelf 24' proximate back wall 18' providing passage for electronic cabling 30 to extend between equipment located on lower shelf 20' and equipment located on middle shelf 10 24'. Accordingly, cable storage slot 52 provides means for simultaneously mounting electronic equipment components on two different shelves while maintaining a path of electrical conductivity between the equipment within and above the area A' defined by lower shelf 20'.

The use of cable storage slot 52 rather than cable storage space 32 may be desirable when equipment to be positioned on middle shelf 24' would not fit on either side of vertically oriented medial connecting means 28, shown in FIG. 1. Indeed, it is foreseeable that removal and replacement of connecting means 28 and middle shelf 24 with a middle shelf 24' may further enhance the flexibility of an electronic equipment support system employing the various embodiments of shelfed support device 10. When cable storage slot 52 is desired, middle shelf 24' may be positioned in abutting relationship with back wall 18' and may be supported by middle shelf support means 58. Middle shelf support means 58 may comprise bracket means, fastening means, or the like. Likewise, the various configurations of cable storage space 32 and cable storage slot 52 may be combined, for example, to provide both upper and middle shelves with means for positioning cabling 30 to achieve the advantages described above.

Accordingly, shelfed support device 10 provides a stacked arrangement of shelf means for support of electronic equipment, such as computer 12 and computer peripheral equipment 14, 16. The shelf means configuration permits simultaneous mounting of electronic equipment components on two or more different shelves while maintaining a path of electrical conductivity between the components, the electrical path being within and above the area defined by the shelf means. A cable storage space 32 or cable storage slot 52 cooperates with other elements of shelfed support device 10 to provide a protective back wall 18 and partial side barriers to encourage electrical safety and to prevent inadvertent access to cabling and electrical ports. Device 10 therefor provides a shelfed support stand for electronic equipment which is transportable and which provides equipment safety and security, personnel safety, and functional flexibility.

It is to be understood that while certain embodiments of the present invention have been illustrated and described, the invention is not to be limited to the specific forms or arrangements of parts described and shown above, since others skilled in the art may devise other embodiments still within the limits of the claims.

What is claimed is:

1. A self-contained, portable shelved support device for a computer and computer peripheral equipment comprising:

(a) a vertically oriented back wall with a base portion, an upper portion, a top edge and a bottom edge;

(b) a horizontally oriented lower shelf perpendicularly connected to the base portion of the back wall, the lower shelf having an area defined by a length and a width;

(c) a horizontally oriented upper shelf perpendicularly connected with the upper portion of the back wall at a location below the top edge of the back wall, the upper shelf having a front surface and a rear surface;

(d) a horizontally oriented middle shelf located between the upper and the lower shelves, the middle shelf having a front surface, a rear surface, and two half sections separated by vertically oriented medial connecting means connected to the middle shelf and to the upper shelf, the connecting means extending from the front surface to the rear surface of the middle shelf;

(e) the rear surface of the middle shelf being spacially separated from the back wall to define a cable storage space permitting simultaneous mounting of computer equipment on both the lower shelf and the middle shelf while continuously maintaining a cabling path of electrical conductivity between the equipment, the path of electrical conductivity thus being located within and above the area defined by the lower shelf, and (f) strengthening means extending vertically and separately between the lower shelf and the upper shelf comprising:

(i) rear located strengthening members attached perpendicularly to the back wall, the lower shelf, and the upper shelf, the rear located members providing nominal barriers for protection of the equipment cabling and for electrical safety; and (ii) forward located strengthening members attached perpendicularly to the lower shelf, the middle shelf, and the upper shelf, the rear located strengthening members and the forward located strengthening members being constructed and arranged to form side apertures in the device to permit cooling of electronic equipment located on each shelf and to provide side access to each shelf to facilitate installation and removal of equipment without separation of the cabling between the equipment.

2. A device according to claim 1 wherein the upper shelf further comprises a circular access port extending therethrough proximate the back wall and the rear surface of the upper shelf to permit passage of electronic cabling from equipment located on the upper shelf to equipment located below the upper shelf, the back wall further comprising an aperture to permit passage of electrical cabling therethrough.

3. A portable shelved support device for a computer and computer peripheral equipment comprising:

(a) a vertically oriented back wall with a base portion and an upper portion, the back wall having a top surface and a bottom surface;

(b) a horizontally oriented lower shelf perpendicularly connected to the base portion of the back wall, the lower shelf having an area defined by a length and a width;

(c) a horizontally oriented upper shelf perpendicularly connected with the upper portion of the back wall at a position below the top surface of the back wall;

(d) a horizontally oriented middle shelf located between the upper and lower shelves, the middle shelf having a front surface, a rear surface, and two half sections separated by vertically oriented medial connecting means connected to the middle shelf and to the upper shelf, the connecting means extending substantially from the front surface to the rear surface of the middle shelf, the rear surface of the middle shelf being spacially separated from the back wall to define a cable storage space permitting simultaneous mounting of computer equipment on both the lower shelf and the middle shelf while continuously maintaining a cabling path of electrical conductivity between the equipment, the path of electrical conductivity thus being located within and above the area defined by the lower shelf; and (e) separate vertically oriented strengthening means extending between the lower shelf and the upper shelf, the strengthening means comprising rear located strengthening members attached to the back wall, to the lower shelf, and to the upper shelf, and forward located strengthening members attached to the lower shelf, to the middle shelf, and to the upper shelf, the strengthening means being constructed and arranged to form side apertures in the device for cooling of electronic equipment located on each shelf and to provide side access for the installation and removal of equipment.

4. A device according to claim 3 further comprising stop means located on the middle shelf to maintain the electronic equipment at the predetermined location and to prevent damage of equipment cabling.

* * * * *